US008069968B2

(12) United States Patent
Zimmermann

(10) Patent No.: US 8,069,968 B2
(45) Date of Patent: Dec. 6, 2011

(54) APPARATUS FOR DISCHARGING A FLAT ARTICLE

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/016,000

(22) Filed: Jan. 28, 2011

(65) Prior Publication Data

US 2011/0203903 A1 Aug. 25, 2011

Related U.S. Application Data

(63) Continuation of application No. PCT/EP2009/059632, filed on Jul. 27, 2009.

(30) Foreign Application Priority Data

Jul. 28, 2008 (DE) ..... 10 2008 035 072

(51) Int. Cl.
*B65G 47/10* (2006.01)

(52) U.S. Cl. ..... 198/369.2; 271/303

(58) Field of Classification Search ..... 198/368, 198/369.1, 369.2, 369.4, 370.01; 271/303
See application file for complete search history.

(56) References Cited

U.S. PATENT DOCUMENTS

| | | | | |
|---|---|---|---|---|
| 3,612,249 | A | 10/1971 | Schneider | |
| 3,724,657 | A | 4/1973 | Katagiri et al. | |
| 5,150,894 | A | 9/1992 | Ricciardi | |
| 5,649,892 | A * | 7/1997 | Auerbach | 198/369.2 |
| 6,032,517 | A | 3/2000 | Reisig et al. | |
| 6,244,419 | B1 * | 6/2001 | Slocum | 198/369.1 |
| 6,349,937 | B1 * | 2/2002 | Gammerler et al. | 198/369.2 |
| 6,533,271 | B1 | 3/2003 | Zimmermann | |
| 6,923,439 | B2 * | 8/2005 | Hashimoto | 271/303 |
| 7,096,743 | B2 | 8/2006 | Vogel et al. | |
| 7,731,184 | B2 * | 6/2010 | Lo et al. | 271/186 |
| 2009/0019942 | A1 | 1/2009 | Knispel | |

FOREIGN PATENT DOCUMENTS

| | | | |
|---|---|---|---|
| DE | 1 927 888 | | 12/1970 |
| DE | 34 24 389 | A1 | 3/1985 |
| DE | 196 36 979 | C1 | 11/1997 |
| DE | 196 00 231 | C2 | 2/1998 |
| DE | 10 2007 034 070 | B3 | 11/2008 |
| EP | 1 133 444 | B1 | 7/2002 |
| EP | 1 542 811 | B1 | 6/2005 |
| GB | 1 274 322 | A | 5/1972 |
| JP | 58-12549 | | 1/1983 |
| JP | 611178743 | | 11/1986 |

* cited by examiner

*Primary Examiner* — James R Bidwell
(74) *Attorney, Agent, or Firm* — Laurence A. Greenberg; Werner H. Stemer; Ralph E. Locher

(57) ABSTRACT

An apparatus for the discharge of an article, in particular of a flat mail item. A first conveyor device is able to transport the article in a primary transport path, a second conveyor device transports it in a branched transport path. A diverter is configured to leave the article either in the primary transport path or to discharge it into the branched transport path. A conveyor belt of the first conveyor device is guided around a roller. This roller is mounted onto the diverter. Thus a pivoting of the diverter from a standby position into a discharge position causes the roller and the conveyor belt resting upon the roller to be displaced perpendicular to the pivot axis of the diverter.

7 Claims, 4 Drawing Sheets

APPARATUS FOR DISCHARGING A FLAT ARTICLE

CROSS-REFERENCE TO RELATED APPLICATION

This application is a continuation, under 35 U.S.C. §120, of copending international application No. PCT/EP2009/059632, filed Jul. 27, 2009, which designated the United States; this application also claims the priority, under 35 U.S.C. §119, of German patent application No. DE 10 2008 035 072.9, filed Jul. 28, 2008; the prior applications are herewith incorporated by reference in their entirety.

BACKGROUND OF THE INVENTION

Field of the Invention

The invention relates to an apparatus for discharging of an article, in particular of a flat mail item, from a transport path.

An apparatus of the generic type is described in U.S. Pat. No. 5,150,894. There, an apparatus for discharging of an article from a main transport path into a branching transport path includes a first conveying device, a second conveying device, and a diverter. The first conveying device is configured for gripping an article intermittently and for transporting it in the main transport path in a main transport direction. The first conveying device comprises a rotationally symmetrical roller, a conveyor belt, and a mating conveyor element, with the roller being connected to the diverter, the conveyor belt bearing against the roller, the conveyor belt and the mating conveyor element being configured for gripping an article intermittently in a clamping region between the conveyor belt and the mating conveyor element and for transporting the gripped article. The second conveying device is configured for gripping an article intermittently and for transporting it in the branching transport path. The diverter is capable of being pivoted to and fro about a diverter pivot axis between a rest position and at least one discharging position, and it is configured for deflecting an article in each discharging position into the branching transport path and for leaving the article in the main transport path in the rest position. The roller is connected to the diverter in such a way that a lever arm occurs between the axis of symmetry of the roller and the diverter pivot axis and pivoting of the diverter into a discharging position brings about that the roller, the conveyor belt which bears against the roller, and the clamping region are displaced perpendicularly with respect to the diverter pivot axis.

In other words, U.S. Pat. No. 5,150,894 describes an apparatus for transporting documents. FIG. 1 of U.S. Pat. No. 5,150,894 shows an apparatus 10 having a first conveying device, which has two endless conveyor belts ("primary conveyor belts 26, 28"), and a second conveying device likewise with two endless conveyor belts ("secondary conveyor belts 40, 42"). Both conveying devices are capable of gripping documents intermittently and transporting them in a transport direction. Two guide elements ("guide arms 62*a*, 62*b*") are mounted one above another on a vertical shaft 64 in such a way that the guide elements 62*a*, 62*b* can be rotated about the shaft 64. A running roller ("idler roller 74") is fastened on a vertical shaft 74*a* between the two guide elements 62*a*, 62*b*. The shaft 74 extends parallel to the shaft 64. A conveyor belt 26 of the first conveying device lies on the running roller 74*a*, with the result that the rotational axis of the running roller 74 lies perpendicularly on the longitudinal axis of the conveyor belt 26.

A document is transported in an upright position by the first conveying device 26, 28 and is deflected into the second conveying device 40, 42 in the case of a corresponding position of the guide elements 62*a*, 62*b*. Here, the endless conveyor belts 26, 28 and later the endless conveyor belts 40, 42 clamp an upright document intermittently between them and transport it. This deflection takes place at the latest when the front edge of a document which is to be discharged has reached a defined point ("reach 26") of the endless conveyor belt 26.

The guide elements 62*a*, 62*b* therefore act as a vane of a diverter, cf. FIG. 3. This diverter vane 62*a*, 62*b* can be rotated about a rotational axis, namely about the rotational axis of the shaft 64. The diverter vane 62*a*, 62*b* can be rotated to and fro between a position, in which the vane 62*a*, 62*b* leaves documents in the main transport path between the endless conveyor belts 26, 28, and a further position, in which the diverter vane 62*a*, 62*b* deflects documents into the branching transport path between the endless conveyor belts 40, 42.

Apparatuses having a main transport path, a branching transport path and a diverter are also described in published Japanese documents JP 61-178743 U and JP 58-012549 U, and in British patent specification GB 1 274 322.

The diverter described in my commonly assigned U.S. Pat. No. 6,533,271 B1 and its counterpart European patent EP 1 133 444 B1 is used in a sorting assembly, in order to discharge flat mail items out of a main transport path into a branching transport path. The diverter comprises two part deflection elements which are connected rigidly and fixedly to one another and can be pivoted about a common pivot axis. A rotationally symmetrical roller is connected to the diverter in such a way that the axis of symmetry of the roller coincides with the pivot axis. A conveyor belt of the branching transport path bears against the roller. The conveyor belt is guided through a cutout of a part deflection element, with the result that the diverter can be pivoted about the pivot axis, without hitting the conveyor belt.

An apparatus for discharging an article is described in U.S. Pat. No. 3,612,249 ad its counterpart German published, non-prosecuted patent application DE 1 927 888 A. The apparatus is configured for transporting containers. The diverter described in U.S. Pat. No. 3,612,249 and DE 1 927 888 A is mounted such that it can be rotated about a rotational axis, and can be pivoted to and fro between two positions. A roller, around which an endless conveyor belt is guided, is mounted on the free tip of the diverter.

U.S. Pat. No. 3,724,657 describes an apparatus which transports upright flat articles. A roller which stands perpendicularly is mounted on a pivoting arm and is capable of deflecting a conveyor belt, with the result that an article is guided into a transport path. If the conveyor belt is not deflected, the conveyor belt transports an article into another transport path.

Commonly assigned German patent DE 196 36 979 C1 describes a discharging apparatus having a diverter and an endless conveyor belt. A mail item is transported through between the conveyor belt and a diverter tongue of the diverter. In order to discharge a mail item, a switching roller is displaced perpendicularly with respect to the transport direction. As a result, the switching roller stretches the conveyor belt and pivots the diverter tongue into a discharging position. The mail item is steered through between the conveyor belt and the diverter tongue into the branching transport path.

SUMMARY OF THE INVENTION

It is accordingly an object of the invention to provide a device for diverting individual flat articles which overcomes the above-mentioned disadvantages of the heretofore-known devices and methods of this general type and which provides for an apparatus that is capable of discharging articles of different thickness and rigidity, wherein it is necessary for the diverter to be pivoted only by a smaller angle than in the case of known apparatuses.

With the foregoing and other objects in view there is provided, in accordance with the invention, an apparatus for discharging an article from a main transport path into a branching transport path, comprising:

a first conveying device configured for gripping an article intermittently and for transporting the article in the main transport path in a main transport direction;

a second conveying device; and a diverter;

the first conveying device including:

a rotationally symmetrical roller connected to the diverter;

a conveyor belt bearing against the roller; and a mating conveyor element;

the conveyor belt and the mating conveyor element being configured for gripping an article intermittently in a clamping region between the conveyor belt and the mating conveyor element and for transporting the article thus gripped;

the second conveying device being configured for gripping an article intermittently and for transporting the in the branching transport path;

the diverter being mounted for pivoting to and fro about a diverter pivot axis between a rest position and at least one discharging position; and being configured for deflecting an article in each discharging position into the branching transport path and for leaving the article in the main transport path in the rest position;

and the roller being connected to the diverter in such a way that a lever arm is formed between an axis of symmetry of the roller and the diverter pivot axis; and pivoting of the diverter into a discharging position causes the roller, the conveyor belt bearing against the roller, and the clamping region to be displaced perpendicularly with respect to the diverter pivot axis;

a diverter drive configured for pivoting the diverter out of the rest position into a standard discharging position, and wherein the diverter is mounted such that an article which is being transported and comes into contact with the diverter is capable of pivoting the diverter beyond the standard discharging position.

The apparatus according to the inventive solution is configured for optionally leaving an article in a main transport path or discharging it into a branching transport path.

The apparatus according to the invention comprises:

a first conveying device, a second conveying device and a diverter.

The first conveying device is configured for gripping an article intermittently and for transporting it in the main transport path.

The second conveying device is configured for gripping an article intermittently and for transporting it in the branching transport path.

The first conveying device comprises:

a rotationally symmetrical roller, a conveyor belt and a mating conveyor element.

The conveyor belt and the mating conveyor element are configured for gripping an article intermittently in a clamping region between the conveyor belt and the mating conveyor element and for transporting the gripped article.

The mating conveyor element is, for example, likewise a conveyor belt or else a sliding element, along which transported articles can slide with low friction.

The conveyor belt bears against the roller.

The diverter can be pivoted to and fro about a diverter pivot axis between a rest position and at least one discharging position. The diverter is configured for deflecting an article in each discharging position into the branching transport path and for leaving the article in the main transport path in the rest position.

The roller is connected to the diverter in such a way that a lever arm occurs between the axis of symmetry of the roller and the diverter pivot axis. Moreover, the roller is connected to the diverter in such a way that pivoting of the diverter into a discharging position brings it about that the roller, the conveyor belt which bears against the roller, and the clamping region are displaced perpendicularly with respect to the diverter pivot axis.

According to the solution, the roller is mounted offset with respect to the diverter pivot axis. As a result, the conveyor belt which bears against the roller is displaced together with the roller, to be precise in a direction perpendicular with respect to the diverter pivot axis.

This brings about the following: it is possible that a conveyor belt of the first conveying device is deflected out of a setpoint position because a rigid article is discharged into the branching transport path. During discharging, however, the diverter is situated in a discharging position. The conveyor belt which bears against the roller which is connected to the diverter, the clamping region and an article which is gripped in the clamping region are deflected in the same direction as the adjacent conveyor belt. The identically directed deflection of both conveyor belts prevents slipping of an article from occurring, while said article is transported in the main transport path.

The apparatus according to the solution can be used in an arrangement which discharges articles with high rigidity into the branching transport path and leaves articles with a lower rigidity in the main transport path and in the process ensures that an article is always gripped by at least one of the two conveying devices. Apparatuses according to the prior art require that the articles with high rigidity remain in the main transport path and the articles with a lower rigidity are discharged into the branching transport path.

The apparatus according to the solution is capable of discharging articles of different thickness and rigidity, without slipping of a transported article occurring.

According to the solution, the diverter can be pivoted into a standard discharging position and beyond this standard discharging position into at least one further discharging position. A diverter drive is capable of pivoting the diverter out of the rest position into the standard discharging position. Each article which is transported in the main transport path and which is to be discharged comes into contact with the diverter if the latter is situated in the standard discharging position. A rigid transported article is capable of pivoting the diverter beyond the standard discharging position. As a result, it is avoided that the rigid article is clamped in between the diverter and a guide roller of a conveyor belt.

In one refinement, furthermore, the discharging apparatus has a guide device. When the diverter is situated in a discharging position, said guide device deflects an article into the branching transport path in interaction with the diverter. The guide device makes an arrangement possible, in which the diverter has to be pivoted by a smaller angle than without a guide device, to be precise even when a rigid and thick article is to be discharged.

In one development, this refinement is combined with the oblique guide device. The oblique guide device is positioned in such a way that a rigid article comes into contact with the diverter close to the front end of the diverter tongue when the diverter is situated in the standard discharging position. This achieves a situation where the diverter drive only has to bring about a pivoting motion which is as small as possible. This brings about a quick switchover between the rest position and a discharging position.

Other features which are considered as characteristic for the invention are set forth in the appended claims.

Although the invention is illustrated and described herein as embodied in an apparatus for discharging of a flat article, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
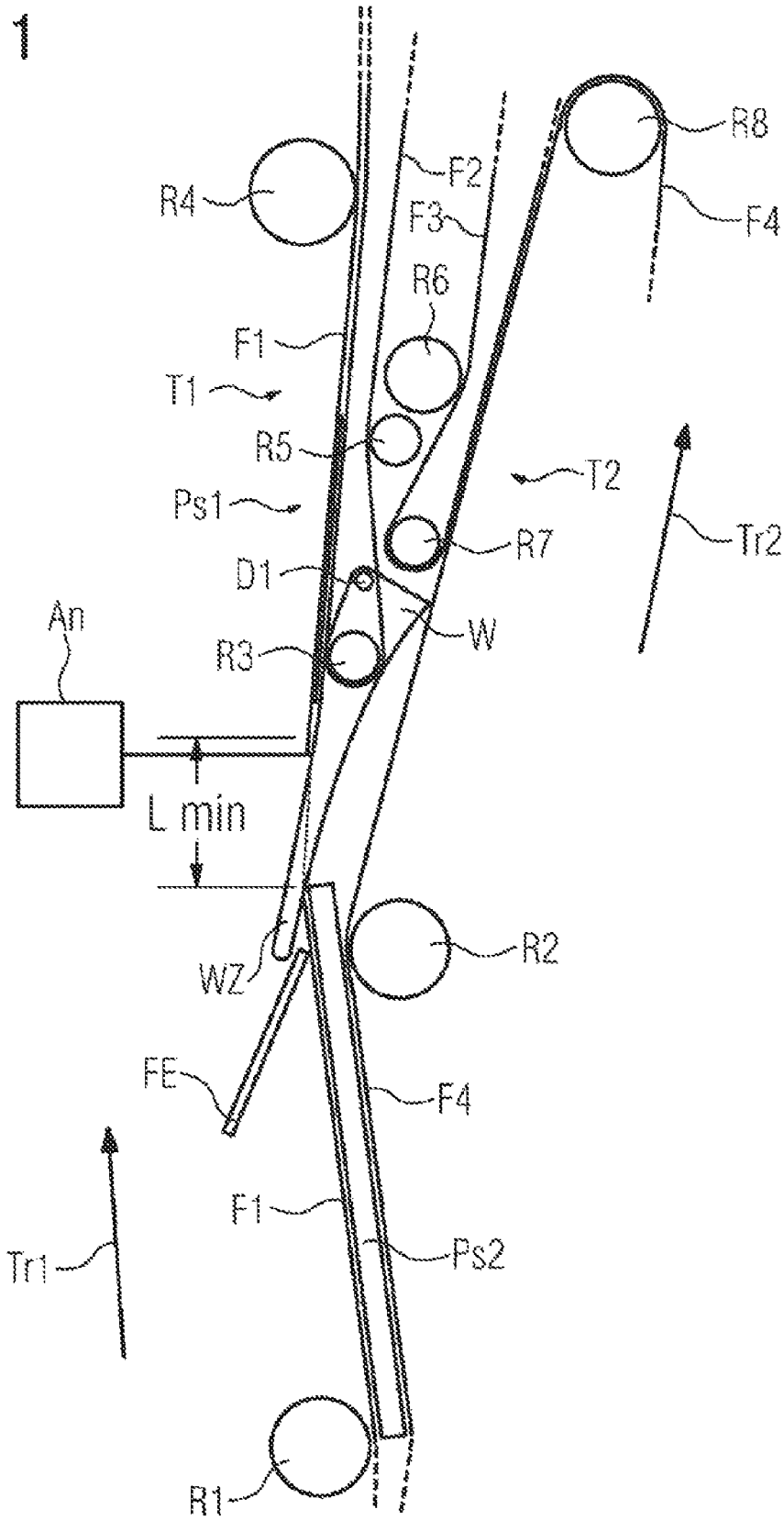
FIG. 1 shows the discharging apparatus in a plan view with the diverter in the standard discharging position at the moment, at which a following thick mail item reaches the diverter and a leading thin mail item has already been discharged.

In the exemplary embodiment, the apparatus according to the solution is used in a sorting assembly which sorts flat mail items, for example standard and large letters, magazines and postcards. Said mail items run through the sorting assembly in a stream of flat mail items which are spaced apart from one another.

A small proportion of the mail items which are fed to the sorting assembly are not machine-compatible because a predefined parameter for this mail item has a value which lies outside a predefined setpoint range. In particular, mail items are not machine-compatible when they are too rigid or too thick. The sorting assembly therefore comprises a measuring apparatus which is arranged upstream of the discharging apparatus according to the solution and measures for each mail item which runs through whether the mail item is machine-compatible or not. For example, said measuring apparatus measures the rigidity of each mail item. Methods and apparatuses, in order to measure the rigidity of mail items, are known, for example, from commonly assigned U.S. Pat. No. 6,032,517 and its counterpart German patent DE 196 00 231 C2, from commonly assigned U.S. Pat. No. 7,096,743 B2 and its counterpart European patent EP 1 542 811 B1, and from commonly assigned U.S. Patent Application Publication No. US 2009/019942 A1 and its counterpart German published patent application DE 102007034070 A1. The foregoing documents are incorporated herein by reference.

The measuring apparatus is connected to the discharging apparatus. In the exemplary embodiment, the discharging apparatus according to the solution is used to discharge the mail items which are not machine-compatible from the stream of mail items. A stream of flat mail items which are spaced apart and are both machine-compatible and not machine-compatible reaches the discharging apparatus. Very flexible and very rigid mail items and also mail items of a different flexural rigidity can be present in the stream of mail items. The lengths of the transported mail items, as viewed in the transport direction, can likewise vary. The order and sequence of the flexural rigidities or lengths cannot be predicted.

The discharging apparatus discharges the mail items which are not machine-compatible into a branching transport path and leaves the machine-compatible mail items in a main transport path. This method of operation reduces the risk that a mail item is damaged, for example bent, during discharging. This is because the discharged mail items are rigid articles which are more resistant to mechanical loadings than the machine-compatible ones which are not discharged.

The machine-compatible mail items which remain in the main transport path subsequently run through the sorting assembly in a stream of mail items which follow one another. The sorting assembly reads the respective delivery address, with which a mail item is provided, and discharges the mail item into one of many outlet devices. The outlet device is, for example, a stationary output compartment or a container. Which output device the sorting assembly discharges the mail item into depends on the delivery address which has been read.

In one embodiment, in each case one branching transport path leads from the main transport path to an output device. A discharging apparatus according to the solution discharges a mail item into the branching transport path when said mail item is to pass into the output device. All or at least some of said discharging apparatuses can also be configured according to the solution.

In the following text, that discharging apparatus according to the solution is described again which discharges the mail items which are not machine-compatible out of the main transport path into a branching transport path and leaves the machine-compatible mail items in the main transport path.

In the exemplary embodiment, the discharging apparatus comprises a plurality of endless conveyor belts which are guided around in each case at least three rollers. Each conveyor belt wraps around the roller with a wraparound angle of at least three degrees. As a rule, in each case exactly one of the rollers, around which a conveyor belt is guided, is driven, and the other rollers are configured as running rollers. The conveyor belts are arranged in such a way that a mail item is transported upright and is clamped in here at every instant between two endless conveyor belts. The rotational axes of the rollers run perpendicularly and are all parallel to one another.

Referring now to the figures of the drawing in detail, there is shown in FIGS. 1 to 4 the discharging apparatus in a plan view. A leading thin mail item Ps1, a following thick and rigid mail item Ps2 and a further following thin mail item Ps3 are shown.

The following endless conveyor belts and rollers can be seen in the figures:

a conveyor belt F1 which is guided, inter alia, around the rollers R1, R2, R3 and R4, a conveyor belt F2 which is guided, inter alia, around the rollers R3, R5 and R7, a conveyor belt F3 which is guided, inter alia, around the rollers R6 and R7, and a conveyor belt F4 which is guided, inter alia, around the rollers R2 and R8.

In the exemplary embodiment, all four conveyor belts are configured as elastic endless conveyor belts which expand and can be twisted about their respective longitudinal axis. They are guided under stress around the respective rollers. The conveyor belt F1 acts as mating conveyor element to the conveyor belt F2.

The conveyor belts F1 and F2 and a section of the conveyor belt F4 form a first conveying device which belongs to a main transport path T1. Said first conveying device is configured for transporting flat mail items in the main transport path T1 in a main transport direction Tr1. The conveyor belt F3 and the other section of the conveyor belt F4 form a second conveying device which belongs to a branching transport path T2. Said transport path T2 branches off from the main transport path T1. Said second conveying device is configured for transporting flat mail items in the branching transport path T2 in a branching transport direction Tr2. The conveyor belt F4 therefore belongs with a front section to the main transport path T1 and with a rear section to the branching transport path T2.

The conveyor belts F1 and F2 form a clamping region KI between them. The conveyor belts F1, F2 are arranged in such a way that they are capable of gripping a flat mail item intermittently between them in the clamping region KI and, as a result, are capable of transporting the gripped mail item in the main transport path T1, and that the conveyor belts F1, F2 move at the same speed. Correspondingly, the conveyor belts F1, F4 form a further clamping region KI1. The conveyor belts F3, F4 form a clamping region in the branching transport path T2.

Whether a mail item is transported further in the main transport path T1 or is discharged into the branching transport path T2 depends on the position of a diverter W. Said diverter W can be pivoted about a diverter pivot axis D1 which stands upright on the plane of the drawing of the figures. In the exemplary embodiment, the diverter W is mounted such that it can be rotated about the diverter pivot axis D1. The diverter W is seated, for example, rotatably on a stationary shaft.

The diverter tongue WZ of the diverter W protrudes into the main transport path T1. The conveyor belts F1 and F2 run through an approximately rectangular cutout which is made in the diverter tongue WZ and cannot be seen in the plan view of the figures. The diverter tongue WZ therefore has the shape of a U with horizontal limbs.

The surface of the diverter W is manufactured from a smooth material, in order that the mail items slide past it with as little friction as possible. In contrast, the surfaces of the conveyor belts are manufactured from a grippy material with a high coefficient of friction, in order for it to be possible to transport the mail items without slipping in the clamping region.

That side face of the diverter W which points to the main transport path T1 is slightly arched, in order that a mail item is deflected gradually and not suddenly into the branching transport direction Tr2 when the diverter W is situated in a discharging position.

A diverter drive An which is shown diagrammatically in the figures is capable of pivoting the diverter W together with the diverter tongue WZ to and fro between a position, in which the diverter W leaves mail items in the main transport path T1 (rest position), and a position, in which the diverter W discharges mail items into the branching transport path T2 (a discharging position).

In the exemplary embodiment, the diverter drive An is capable of pivoting the diverter W to and fro between the rest position and a standard discharging position. The diverter drive An is actuated by a control device which is connected to the measuring apparatus. As soon as the front edge of a mail item which is not machine-compatible has undershot a minimum spacing from the diverter tongue, the control device actuates the diverter drive An, whereupon the diverter drive An pivots the diverter into the standard discharging position. As soon as the mail item which is not machine-compatible has been discharged into the branching transport path, a restoring device pivots the diverter back into the rest position again.

Figure 4:
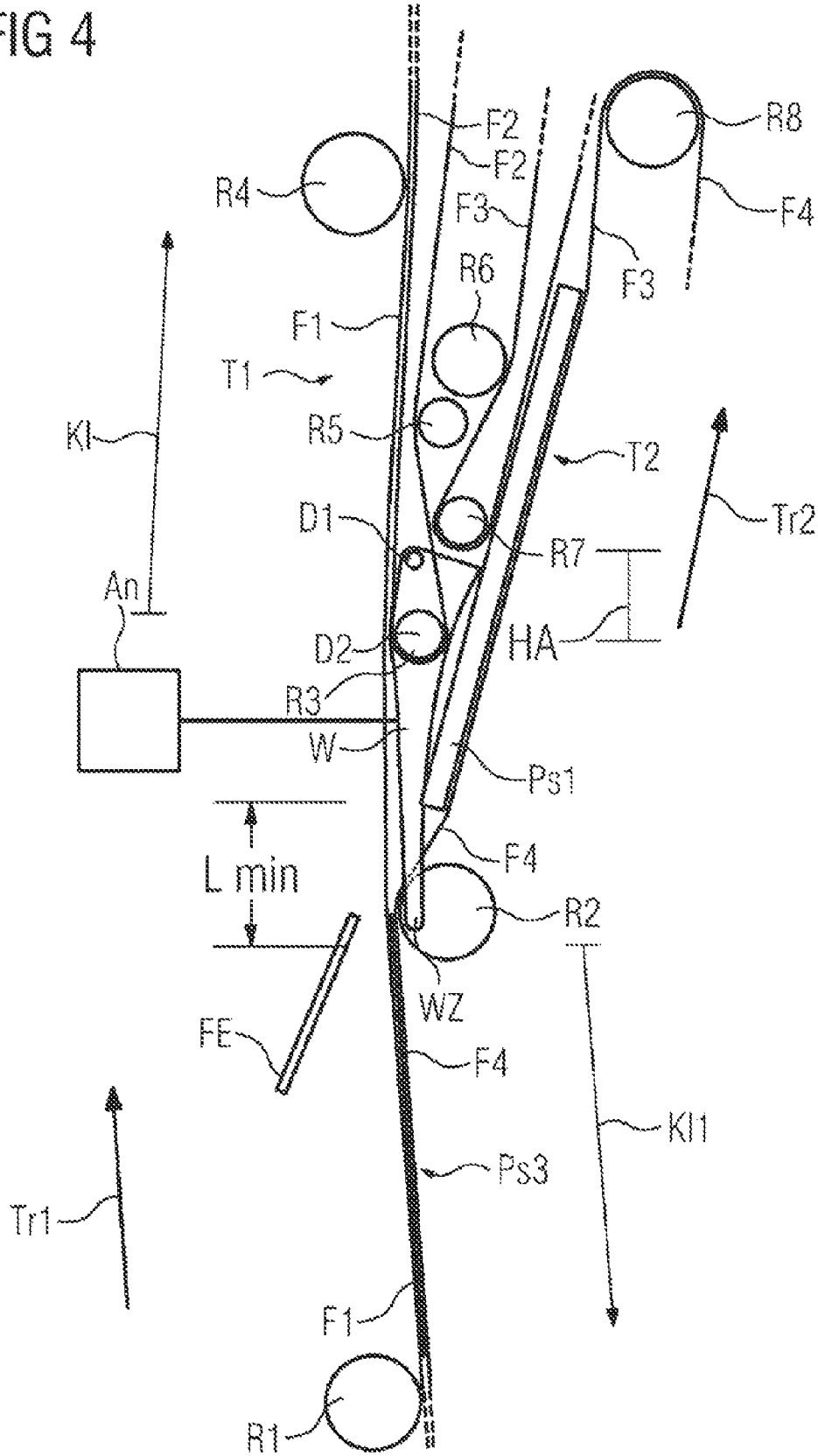
FIG. 4 shows the discharging apparatus of FIG. 3 at the moment, at which the following thick mail item has been discharged completely into the branching transport path and a following thin mail item has almost reached the diverter.

In FIG. 4, the diverter W is situated in the rest position, and, in FIG. 1, it is situated in the standard discharging position.

Furthermore, the discharging apparatus comprises a guide device FE which has, for example, the form of a guide plate and is attached in a stationary manner. That surface of the guide device which faces the main transport path T1 can be straight or else be arched away from the main transport path T1. A spacing which is greater than the thickness of the thickest mail item to be transported occurs between said guide device FE and the roller R2. The guide device FE deflects mail items in the direction of the branching transport path T2 in interaction with the diverter W.

Thanks to the guide device FE, the diverter drive An needs to pivot the diverter W only by a smaller angle out of the rest position into the standard discharging position. Without the guide device, the diverter W would have had to be pivoted by a greater angle out of the rest position into the discharging position, in order to ensure that each mail item which is to be discharged into the branching transport path T2 is gripped by the diverter tongue WZ.

The diverter W can be pivoted about the diverter rotational axis D1 beyond the standard discharging position, no longer by the diverter drive An but rather by a rigid mail item which is to be discharged and comes into contact with the diverter W which is in the standard discharging position. The mail item comes into contact, while the first conveying device F1, F2 transports the mail item in the main transport direction Tr1. This prevents a rigid and long mail item being clamped in between the diverter W and the rollers R1 and R2.

The diverter is preferably pivoted out of the rest position into a discharging position counter to the force of a spring. The spring restores the diverter W back into the rest position again.

The roller R3 is rotationally symmetrical with regard to a roller axis of symmetry D2. In the exemplary embodiment, the roller axis of symmetry D2 runs parallel to the diverter pivot axis D1, around which the diverter W can be pivoted to and fro. The spacing between the two axes D1 and D2 remains constant during the pivoting to and fro and acts as a lever arm HA.

In the exemplary embodiment, the roller R3 is configured as a running roller. In one refinement, the roller is mounted rotatably on the diverter W. The roller rotational axis D2, about which the roller R3 is mounted rotatably, is identical to the roller axis of symmetry D2. The running roller R3 rotates together with the driven conveyor belt F2. In another refinement, the running roller R3 has a smooth surface, and the conveyor belt F2 is guided around the running roller R3 and slides over the smooth surface. The axis of symmetry D2 of the rotationally symmetrical roller R3 is also parallel to the diverter pivot axis D1 in this refinement.

The roller R3 is mounted on the diverter W in such a way that the roller R3 is situated between the diverter tongue WZ and the diverter pivot axis D1.

The roller R3 is displaced laterally when the diverter W is pivoted. As a result, the conveyor belt F2 also moves with it when the diverter W is pivoted about the diverter pivot axis D1.

The diverter W and the roller R3 are arranged in such a way that a minimum spacing (a minimum gap) L_min between a leading and a following mail item is not undershot ever. L_min is a predefined value.

The leading mail item is always clamped in between in each case two conveyor belts, even if the leading mail item has only a predefined minimum length and is very flexible and thin, and the following mail item is to be discharged into the branching transport path T2 and is flexurally rigid. It is shown in all the figures how large the minimum gap L_min is which is to be maintained and which is actually maintained.

All the figures show a leading thin mail item Ps1 and a following thick and rigid mail item Ps2. Moreover, FIG. 4 shows a further following thin mail item Ps3. The apparatus according to the solution ensures that the thin mail items Ps1 and Ps3 are always clamped in without slipping between two conveyor belts which lie opposite one another and, as a result, are transported at the same speed as said conveyor belts, to be precise even if the thick and rigid mail item Ps2 is discharged. The minimum gap L_min which is to be maintained between the leading mail item Ps1 and a following mail item Ps2 is indicated in the figures.

In FIG. 1, the leading thin and machine-compatible mail item Ps1 is situated at the level of the diverter W and remains in the main transport path Tr1. The following thick mail item Ps2 is not machine-compatible and is discharged into the branching transport path Tr2.

The diverter W has been pivoted into the standard discharging position. The diverter drive An has rotated the diverter W about the diverter pivot axis D1 out of the rest position into the standard discharging position, before the following mail item Ps2 has reached the position shown in FIG. 1.

The following mail item Ps2 has a high flexural rigidity. It therefore spreads the conveyor belts F1 and F4 apart. The conveyor belt F1 is deflected perpendicularly with respect to the main transport direction Tr1 because the conveyor belt F1 is held by the roller R1 and the conveyor belt F2 is held by the roller R2. The mail item Ps2 makes contact with the guide device FE by way of its front edge and is clamped in between the conveyor belts F1 and F4. The diverter drive An needs to actively pivot the diverter W only as far as shown in FIG. 1. The guide device FE prevents the mail item Ps2 from coming into contact with the diverter tongue WZ, which could lead to damage of the mail item Ps2 or of the diverter tongue WZ, or the mail item Ps2 is even transported past the diverter tongue WZ.

Figure 2:
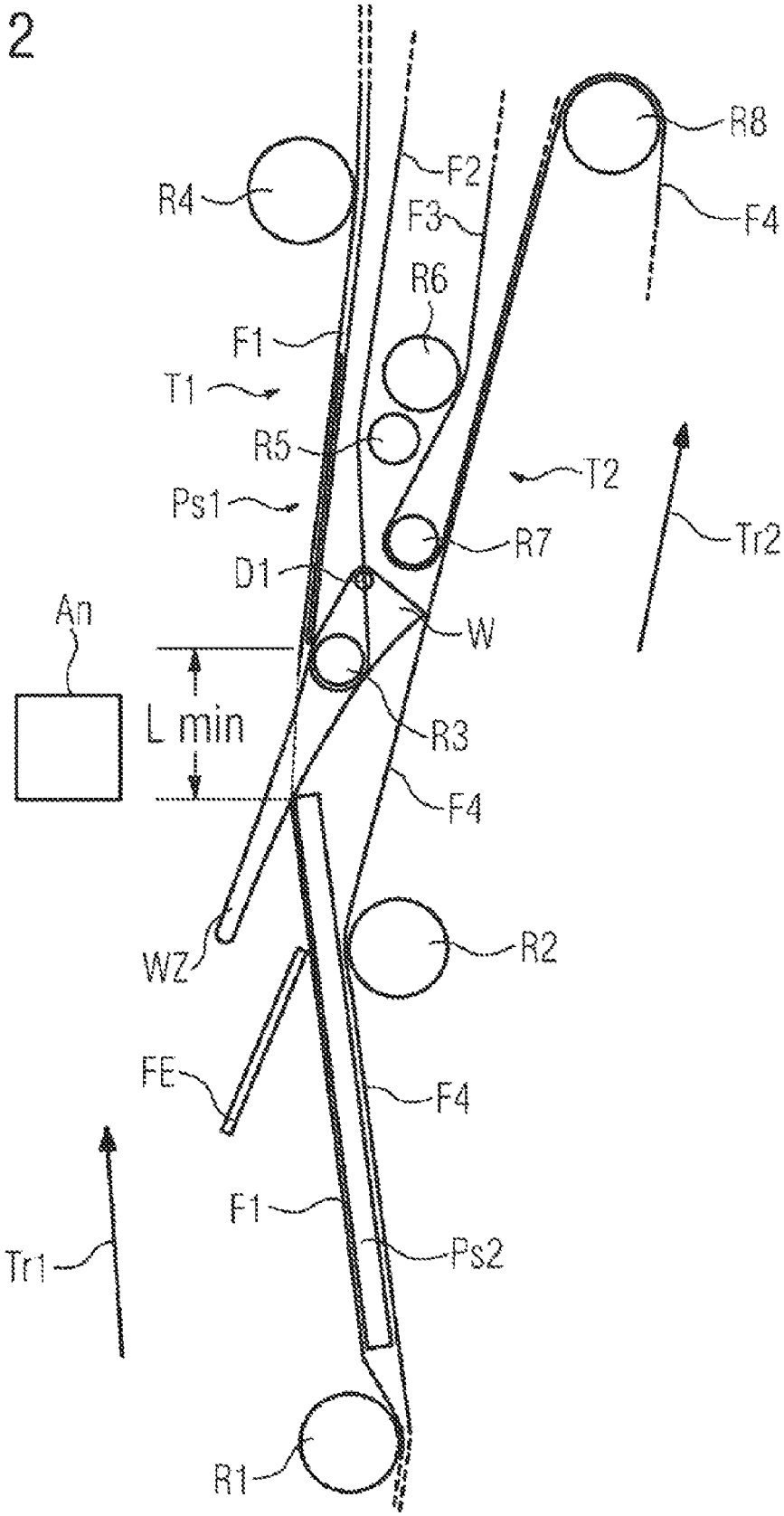
FIG. 2 shows the discharging apparatus of FIG. 1 which has transported the following thick mail item further, the diverter having been pivoted beyond the standard discharging position.
Figure 3:
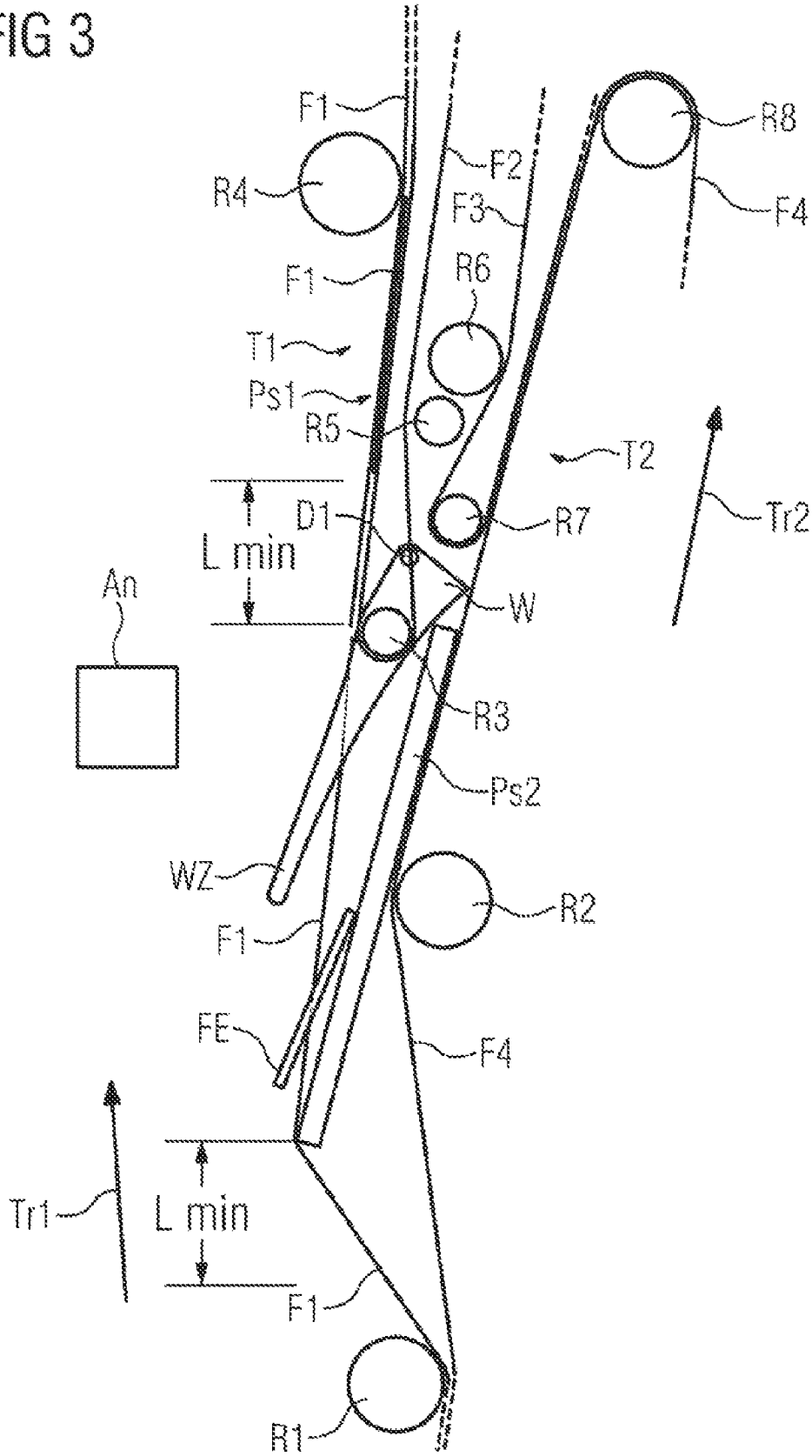
FIG. 3 shows the discharging apparatus of FIG. 2 at the moment, at which the front edge of the following thick mail item has reached the branching transport path.

In FIG. 2 and FIG. 3, the diverter W is also situated in a discharging position. The rigid mail item Ps2 is gradually discharged into the branching transport path.

The diverter W has a play which makes a rotation of the diverter W about the diverter pivot axis D1 possible, which rotation is greater than that pivoting which the diverter drive An brings about actively. This further pivoting is brought about by a rigid mail item which is to be discharged, which is shown in FIG. 2. Furthermore, the mail item Ps2 is transported in the main transport direction Tr1 by the conveyor belts F1 and F4. The rigid mail item Ps2 rotates the diverter W beyond the standard discharging position into the position shown in FIG. 2. As a result, the roller R3 is also displaced further.

In interaction with the guide device, the diverter tongue WZ deflects the mail item Ps2 into the branching transport path T2, which mail item Ps2 is still clamped in between the conveyor belts F1 and F4. The front edge of the mail item Ps2 slides past the diverter tongue WZ here. The rear edge of the mail item Ps2 deflects the conveyor belt F1 and tautens it. The guide device FE prevents excessively pronounced deflection of the rigid mail item Ps2 and therefore excessively pronounced tautening of the conveyor belt F1.

In FIG. 3, the front edge of the following mail item Ps2 is just gripped by the conveyor belt F2 and is clamped in between the conveyor belts F2 and F4. The clamping action is ensured, inter alia, by the roller R3 being mounted on the diverter W. The diverter W is rotated back by the spring and, in FIG. 3, is still rotated beyond the standard discharging position, but no longer as far as in FIG. 2.

The mail item Ps1 is clamped in by the conveyor belts F3 and F4 in a clamping region between the conveyor belts F3 and F4. Because the mail item Ps2 is rigid and relatively thick, it spreads the conveyor belt F4 to the outside, while the conveyor belt F3 is held in its position by the roller R7 in FIG. 3.

According to the solution, the roller R3 is mounted on the diverter W. As a result, the rigid mail item Ps2 not only stretches the conveyor belt F1 during the discharging, but also additionally displaces the roller R3. As a result, the conveyor belt F2 is also displaced which, inter alia, is guided around the deflected roller R3, to be precise toward the conveyor belt F1 (to the left in the figures). This brings it about that the thin leading mail item Ps1 which remains in the main transport path T1 always remains clamped by the two conveyor belts F1 and F2, even when the conveyor belt F1 is deflected by the rigid mail item Ps2.

FIG. 4 shows a situation, in which the rigid mail item has been discharged completely into the branching transport path T2. A restoring device has pivoted the diverter W into the rest position again.

In one embodiment, the restoring device is a compression or tension spring which is arranged in such a way that it presses the diverter W into the rest position. The diverter drive An therefore pivots the diverter W counter to the spring force of the spring. In another embodiment, the diverter drive An is additionally configured as a restoring device. The diverter drive An therefore rotates the diverter W out of the discharging position about the diverter rotational axis D1 back into the rest position. This refinement has the advantage that the diverter drive An does not have to work counter to the spring force, but requires a somewhat more complicated diverter drive An.

In FIG. 4, furthermore, an additional thin, machine-compatible mail item Ps3 can be seen. This follows the discharged mail item Ps2 and is to remain in the main transport path T1. The diverter W therefore has to have assumed the rest position again when the mail item Ps3 has reached the position shown in FIG. 4. The minimum spacing L_min between the mail items Ps2 and Ps3 is shown.

Up to now, one embodiment has been described which can lead to the situation shown in FIG. 3: during discharging, the conveyor belt F1 is stretched. An alternative embodiment avoids this. The conveyor belt F1 is additionally guided around a roller (not shown) which can be displaced parallel to the main transport direction Tr1. A displacement of this roller brings about a situation where the available length of the conveyor belt F1 changes, in the manner of a self-retracting dog leash. In the situation of FIG. 3, said roller lengthens the conveyor belt F1 and afterward shortens it again. This avoids tautening of the conveyor belt F1.

The following elements and corresponding labels and designating numerals appear in the figures and in the description. This list will aid the reader in the understanding of the specification:

An Diverter drive

D1 Diverter pivot axis, about which the diverter W can be pivoted

D2 Axis of symmetry of the roller R3

HA Lever arm between the axis of symmetry of the roller (R3) and the diverter pivot axis (D1)

FE Guide device in the form of a guide plate

HA Lever arm which occurs between the diverter pivot axis D1 and the axis of symmetry D2 of the roller R3

KI Clamping region in the main transport path between the conveyor belts F1 and F2

KI1 Clamping region in the main transport path between the conveyor belts F1 and F4

KI2 Clamping region in the branching transport path between the conveyor belts F1 and F4

L_min Maximum gap between a leading and a following mail item

Ps1 Leading thin mail item

Ps2 Following thick and rigid mail item

Ps3 Following thin mail item

R1, R2, R3, R4 Rollers, around which the conveyor belt F1 is guided

R3 Roller which is mounted on the diverter W and around which the conveyor belt F2 is guided R5, R7 Further rollers, around which the conveyor belt F2 is guided R6, R7 Rollers, around which the conveyor belt F3 is guided R2, R8 Rollers, around which the conveyor belt F4 is guided T1 Main transport path, from which the transport path T2 branches off; comprises the first conveying device with the conveyor belts F1 and F2 and a front section of the conveyor belt F4

T2 Transport path which branches off from the main transport path T1; comprises the second conveying device with the conveyor belt F3 and the other section of the conveyor belt F4

Tr1 Main transport direction, in which the main transport path T1 transports mail items Tr2 Branching transport direction, in which the branching transport path T2 transports mail items W Diverter for discharging WZ Diverter tongue of the diverter W.

The invention claimed is:

1. An apparatus for discharging an article from a main transport path into a branching transport path, comprising:

a first conveying device configured for gripping an article intermittently and for transporting the article in the main transport path in a main transport direction;

a second conveying device; and a diverter;

said first conveying device including:

a rotationally symmetrical roller connected to said diverter;

a conveyor belt bearing against said roller; and a mating conveyor element;

said conveyor belt and said mating conveyor element being configured for gripping an article intermittently in a clamping region between said conveyor belt and said mating conveyor element and for transporting the article thus gripped;

said second conveying device being configured for gripping an article intermittently and for transporting the in the article branching transport path;

said diverter being mounted for pivoting to and fro about a diverter pivot axis between a rest position and at least one discharging position; and being configured for deflecting an article in each discharging position into the branching transport path and for leaving the article in the main transport path in the rest position;

and said roller being connected to the diverter in such a way that a lever arm is formed between an axis of symmetry of said roller and said diverter pivot axis; and pivoting of said diverter into a discharging position causes said roller, said conveyor belt bearing against said roller, and said clamping region to be displaced perpendicularly with respect to said diverter pivot axis;

a diverter drive configured for pivoting said diverter out of the rest position into a standard discharging position, and wherein said diverter is mounted such that an article which is being transported and comes into contact with the diverter is capable of pivoting the diverter beyond the standard discharging position.

2. The apparatus according to claim 1, wherein said diverter is mounted for pivoting to and fro by rotation about a diverter pivot axis.

3. The apparatus according to claim 2, wherein said diverter comprises a diverter tongue, and said roller axis of symmetry runs between said diverter tongue and said diverter pivot axis.

4. The apparatus according to claim 2, wherein said roller axis of symmetry runs parallel to said diverter pivot axis.

5. The apparatus according to claim 1, which further comprises a guide device arranged obliquely with respect to the main transport direction such that, when said diverter is situated in the discharging position, a forward region of said diverter, as viewed in the main transport direction, is shadowed by said guide device, to prevent contact of an article being transported on the forward region.

6. The apparatus according to claim 5, wherein said mating conveyor element is a conveyor belt, and the apparatus further comprises a length-modifying device configured for:

increasing a length of said mating conveyor element available for transporting when said diverter is pivoted beyond the standard discharging position; and decreasing the available length when said diverter is pivoted back into the rest position.

7. The apparatus according to claim 1, wherein said diverter is formed with a cutout at a forward end thereof, as viewed in the main transport direction, and said cutout is configured such that, when said diverter is situated in a discharging position, said conveyor belt and/or said mating conveyor element runs through said cutout.

* * * * *